US006516473B2

(12) United States Patent
Saito

(10) Patent No.: US 6,516,473 B2
(45) Date of Patent: Feb. 11, 2003

(54) DISPOSABLE PANTS OF TRUNKS-TYPE

(75) Inventor: Akiko Saito, Kagawa-ken (JP)

(73) Assignee: Uni-Charm Corporation, Ehime-Ken (JP)

( * ) Notice: Subject to any disclaimer, the term of this patent is extended or adjusted under 35 U.S.C. 154(b) by 194 days.

(21) Appl. No.: 09/746,271

(22) Filed: Dec. 21, 2000

(65) Prior Publication Data

US 2001/0013139 A1 Aug. 16, 2001

(30) Foreign Application Priority Data

Dec. 21, 1999 (JP) ..... 11-362581

(51) Int. Cl.[7] ..... A41B 11/00
(52) U.S. Cl. ..... 2/400; 2/403
(58) Field of Search ..... 2/400, 403, 405, 2/406, 408, 402, 404, 407, 228, 238; 604/385.01, 385.25, 385.29, 385.3, 394, 396

(56) References Cited

U.S. PATENT DOCUMENTS 4,205,679 A * 6/1980 Repke et al. ..... 604/385.01
4,327,448 A * 5/1982 Lunt ..... 2/402
4,630,320 A * 12/1986 Van Gompel ..... 2/406
4,698,855 A * 10/1987 Hicks ..... 2/402
4,745,636 A * 5/1988 Lunt ..... 2/402
4,883,481 A * 11/1989 Blanchard ..... 605/385.1
5,340,424 A * 8/1994 Matsushita ..... 2/401 X
5,440,764 A * 8/1995 Matsushita ..... 2/401
5,864,890 A * 2/1999 Niedermyer ..... 2/403
6,092,242 A * 7/2000 Niedermyer ..... 2/400
6,240,563 B1 * 6/2001 Nierdermyer ..... 2/114
6,289,519 B1 * 9/2001 Murakami et al. ..... 2/400
6,308,339 B1 * 10/2001 Murakami et al. ..... 2/400

* cited by examiner

*Primary Examiner*—Gloria M. Hale
(74) *Attorney, Agent, or Firm*—Baker & Daniels

(57) ABSTRACT

Disposable trunks-type pants that include a pair of inner sheets each having a cutout lying between their front and rear side portions and a pair of outer sheets. The inner sheets having respective sheet surfaces bonded together along zones of the front and rear side portions extending in vicinity of upper ends of these sheets as well as along the respective cutouts. The respective sheet surfaces of the inner sheets and respective sheet surfaces of the outer sheets are bonded together along the front and rear side portions of these sheets. Elastic members are attached to the outer sheets along the upper ends thereof.

3 Claims, 3 Drawing Sheets

DISPOSABLE PANTS OF TRUNKS-TYPE

BACKGROUND OF THE INVENTION

This invention relates to disposable pants of trunks-type.

Pants in the form of trunks or briefs have usually been made by cutting respective components such as a front body and a rear body out from common or separate stock material (s) and then stitching them together. Upon completion of stitching, the assemblies are subjected to a step of finishing, for example, by thermal setting and then inspected to obtain finished goods. These pants have been made on the assumption that they should be reusable.

Recently, the demand has rapidly increased for the disposable pants used by surgeons, nurses and patients during operation or examination and thrown away after used. On the contrary, the reusable pants require unacceptably much labor and high manufacturing cost to be thrown away after a single use since such pants made on the assumption that they should be reusable are obtained by a plurality of steps such as those of cutting, stitching and finishing.

SUMMARY OF THE INVENTION

An object of this invention is to provide disposable pants of trunks-type adapted to be easily made at a reasonable cost and to be thrown away after a single use.

According to this invention, there is provided disposable pants of trunks-type comprising a waist-hole and a pair of leg-holes wherein the waist-hole is provided in vicinity of a peripheral edge thereof with an elastically stretchable member secured under tension thereto so as to extend circumferentially of the pants.

This invention further comprises a pair of symmetric inner sheets each having upper and lower ends extending in a transverse direction, front and rear side portions extending in a longitudinal direction orthogonal to the transverse direction and a cutout extending from the upper end toward the lower end so as to describe a substantially circular arc which is convex toward the lower end and a pair of symmetric outer sheets having upper and lower ends extending in the transverse direction and front and rear side portions extending in the longitudinal direction and lying outside the inner sheets; and the inner sheets are placed upon each other with the upper and lower ends as well as the front and rear side portions of these sheets put in conformity with each other, respectively, and respective sheet surfaces thereof bonded to each other at least along zones of the front and rear side portions extending in vicinity of the upper ends of the sheets and the cutouts with the upper and lower ends as well as the front and rear portions of these sheets put in conformity with each other, respectively, the inner sheets and the outer sheets are placed upon one another with the upper and lower ends as well as the front and rear side portions put in conformity with each other, respectively, with the sheet surfaces of the inner sheets and respective sheet surfaces opposed to the sheet surfaces of the inner sheets bonded together along the front and rear side portions of these sheets, and the elastic members are attached to the respective the outer sheets along the upper ends thereof, respectively.

According to one preferred embodiment of this invention, the inner sheets and/or the outer sheets are formed by nonwoven fabric.

According to another preferred embodiment of this invention, the nonwoven fabric is composite nonwoven fabric consisting of melt blown nonwoven fabric and two layers of spun bond nonwoven fabric having respective sheet surfaces covering opposite sheet surfaces of the melt blown nonwoven fabric.

DETAILED DESCRIPTION OF THE PREFERRED EMBODIMENTS

Details of disposable pants of trunks-type according to this invention will be more fully understood from the description given hereunder with reference to the accompanying drawings.

Figure 1:
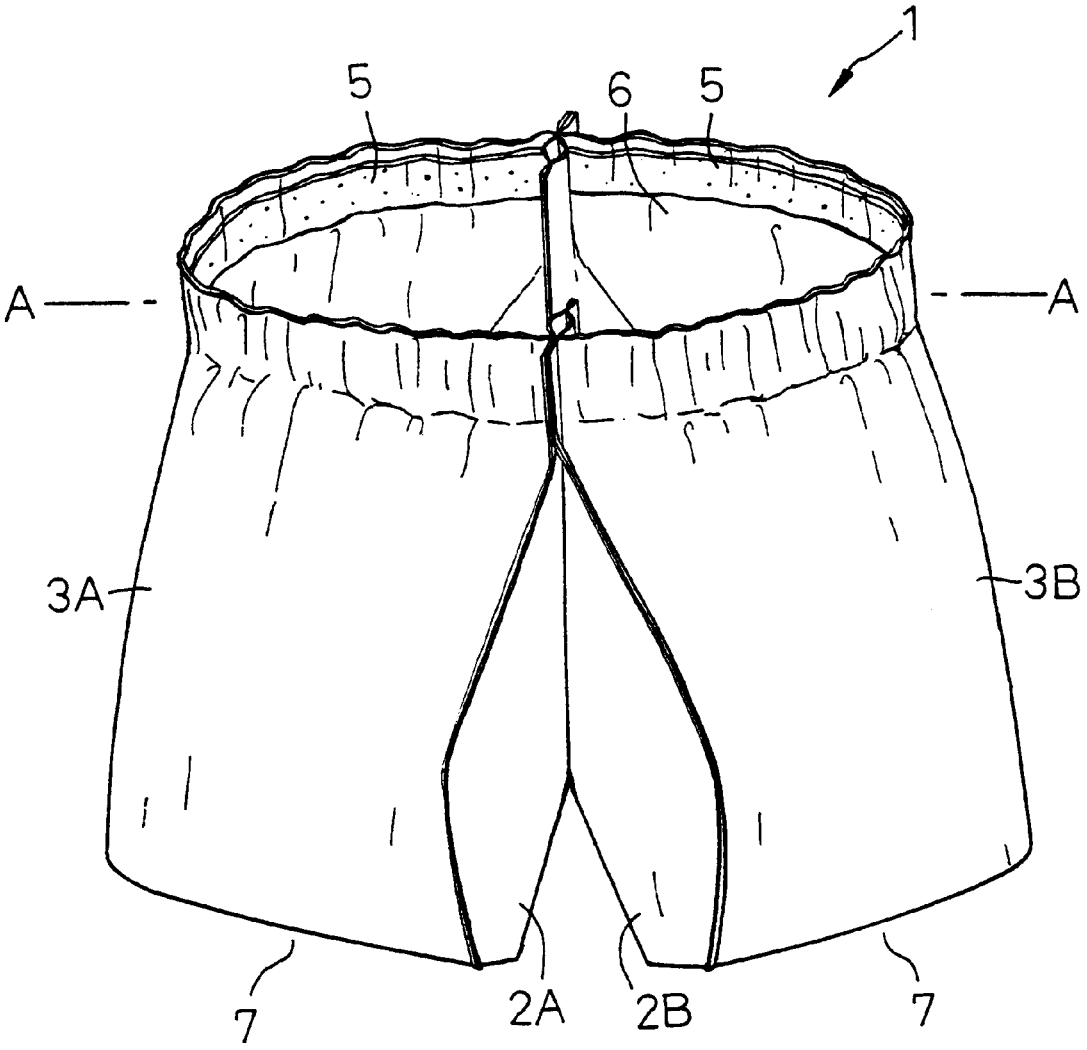
FIG. 1 is a perspective view of disposable pants of trunks-type according to one embodiment of the present invention as viewed from the front.
Figure 2:
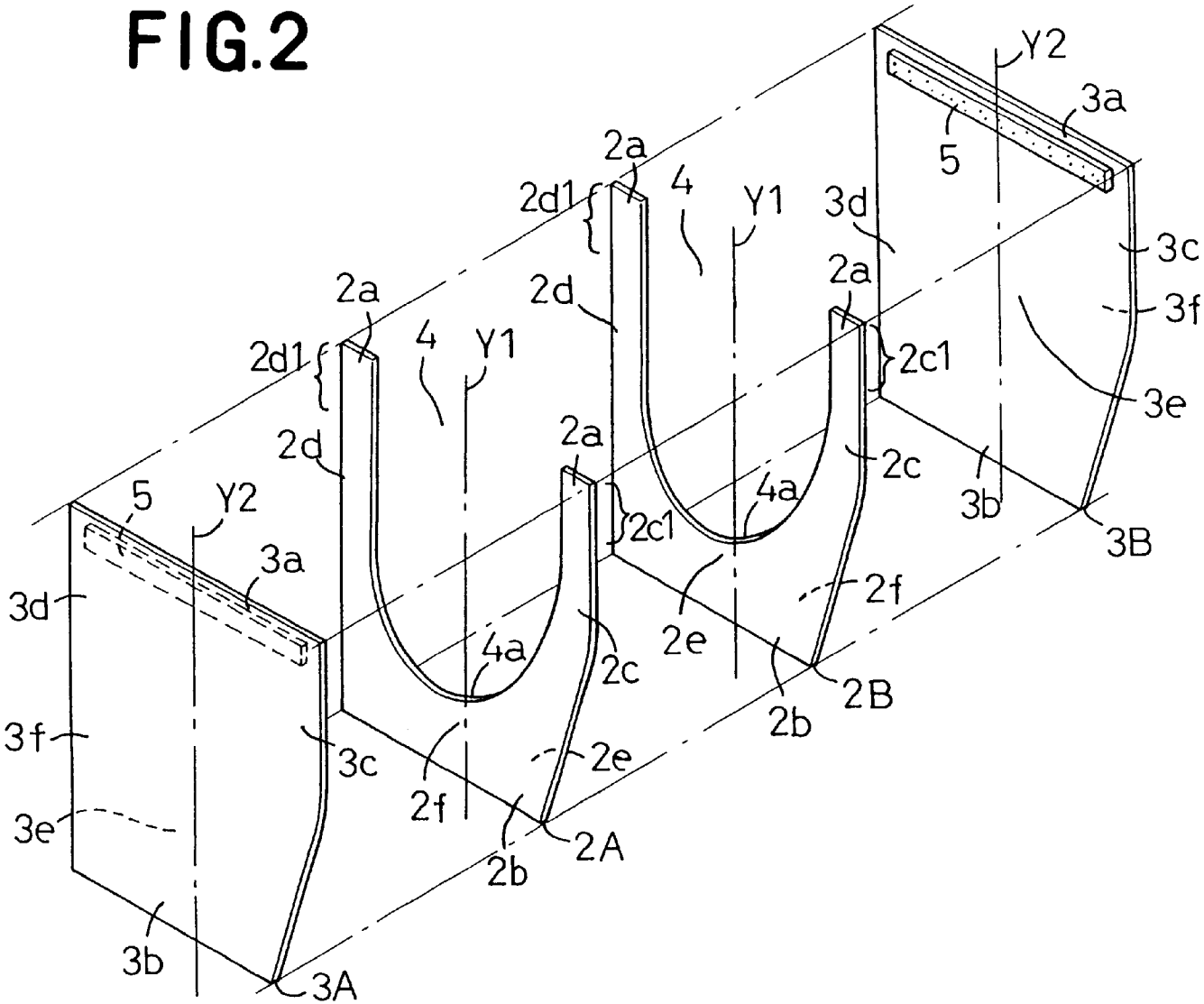
FIG. 2 is an exploded perspective view of the pants shown in FIG. 1.

FIG. 1 is a perspective view of disposable pants 1 as viewed from the front and FIG. 2 is an exploded perspective showing the pants 1 shown in FIG. 1. The pants 1 comprise a pair of inner sheets 2A, 2B being identical to each other in shape as well as in size and a pair of outer sheets 3A, 3B being identical to each other in shape as well as size are arranged laterally as viewed in FIG. 2. The pants 1 are formed at an upper end with a waist-hole 6 at a lower end with a pair of leg-holes 7. The waist-hole 6 is provided in the vicinity of peripheral edge of the waist-hole 6 with an elastically stretchable member 5 in the form of film extending circumferentially of the pants and secured under tension to the pants 1. Referring to FIG. 1, gathers are formed along the waist-hole 6 of the pants 1 as the elastic member 5 is relieved of tension.

Referring to FIG. 2, the inner sheets 2A, 2B are placed in plane-symmetrical relationship with each other and the outer sheets 3A, 3B are placed also in plane-symmetrical relationship with each other outside the respective inner sheets 2A, 2B. Each of the inner sheets 2A, 2B has upper and lower ends 2*a*, 2*b* transversely extending in parallel to each other and front and rear side portions 2*c*, 2*d* vertically extending in parallel to each other. These inner sheets 2A, 2B are formed between the respective front and rear side portions 2*c*, 2*d* with cutouts 4 extending from the respective upper ends 2*a* to describe substantially circular arcs which are convex toward the respective lower ends 2*b*. The front side portion 2*c* of the inner sheet 2A, 2B has its inner side edge extending downward to describe a substantially circular arc gradually approaching a vertical center line Y1 bisecting a dimension defined between the front side portion 2*c* and the rear side portion 2*d*. In other words, a transverse dimension of the inner sheet 2A, 2B is larger at its upper end 2*a* than at its lower end 2*b*.

Each of the outer sheets 3A, 3B has upper and lower ends 3*a*, 3*b* transversely extending in parallel to each other and front and rear side portions 3*c*, 3*d* vertically extending in parallel to each other. The front side portion 3*c* of the outer sheet 3A, 3B has its outer side edge extending downward to describe a substantially circular arc gradually approaching a vertical center line Y2 bisecting a dimension defined between the front side portion 3*c* and the rear side portion 3*d*. In other words, a transverse dimension of the outer sheet 3A, 3B is larger at its upper end 3*a* than at its lower end 3*b*. These outer sheets 3A, 3B are provided on their opposed surfaces 3*e* with elastic members 5 secured under tension thereto so as to extending transversely along the respective upper ends 3*a* of these outer sheets 3A, 3B.

From the components shown by FIG. 2 in the exploded perspective view, the pants 1 may be obtained in a manner as will be described. First, the respective sheet surfaces 2*e* of the inner sheets 2A, 2B are placed upon each other so that the respective center lines Y1 of the inner sheets 2A, 2B may coincide with each other and then the sheet surfaces 2*e* of the inner sheets 2A, 2B are continuously or intermittently bonded to each other along zones 2*c*1, 2*d*1 of the front and rear side portions 2*c*, 2*d* lying in the vicinity of the respective upper ends 2*a* as well as along the cutouts 4. Obviously, the inner sheets 2A, 2B placed upon and bonded to each other in this manner should have their upper and lower ends 2*a*, 2*b*, front and rear side portions 2*c*, 2*d* and cutouts 4 being coincident with each other, respectively.

After the sheet surface 2*e* of the inner sheets 2A, 2B have been bonded to each other, sheet surface 3*e* of the outer sheets 3A, 3B are placed upon sheet surfaces 2*f* of the inner sheets 2A, 2B so that the respective center lines Y1, Y2 of these sheets 2A, 2B, 3A, 3B may fall in line. Then, the sheet surface 2*f* of the one inner sheet 2A and the sheet surface 3*e* of the one outer sheet 3A opposed to the sheet surface 2*f* of the one inner sheet 2A are continuously or intermittently bonded to each other along the respective front and rear portions 2*c*, 2*d*; 3*c*, 3*d* of these inner and outer sheets 2A, 3A with the elastic member 5 being maintained under tension. Similarly, the sheet surface 2*f* of the other inner sheet 2B and the sheet surface 3*e* of the other outer sheet 3B are bonded to each other. It will be obviously understood that the inner and outer sheets 2A, 2B, 3A, 3B placed upon and bonded to one another in this manner should have their upper and lower ends 2*a*, 2*b*, 3*a*, 3*b*, front and rear side portions 2*c*, 2*d*, 3*c*, 3*d* being coincident with each other, respectively.

By bonding the respective sheet surfaces 2*e* of the inner sheets 2A, 2B along the zones 2*c*1, 2*d*1 of the front and rear side portions 2*c*, 2*d* lying in the vicinity of the respective upper ends 2*a* of the inner sheets 2A, 2B, bonding strength as measured circumferentially of the pants 1 is enhanced with respect to the case in which the surfaces 2*e* are not bonded along said zones 2*c*1, 2*d*1. Therefore, it is not apprehended that the pants 1 might be broken along the cutouts 4 of the inner sheets 2A, 2B even if the waist-hole of the pants 1 is stretched circumferentially outward as the pants are put on a wearer's body.

The respective sheet surfaces 2*e* of the inner sheets 2A, 2B are bonded together preferably in such a manner that marginal edges of the front and rear sie portions 2*c*, 2*d* and the cutouts 4 are left not bonded. In this way, the rigidity of the regions in which the inner sheets 2A, 2B have been bonded together is alleviated by the presence of the marginal edges left free from bonding effect when the marginal edges of the front and rear side portions 2*c*, 2*d* come into contact with the wearer or even when the marginal edges of the cutouts 4 come in contact with the wearer's crotch.

The respective sheet surfaces 2*f*, 3*e* of the inner sheets 2A, 2B and the outer sheets 3A, 3B are bonded one to another preferably the marginal edges of their front and rear side portions left free from the bonding effect. In this way, the rigidity of the regions in which these sheets 2A, 2B, 3A, 3B have been bonded together is alleviated by the presence of the marginal edges left free from the bonding effect and thereby any possible stimulation to the wearer's skin is correspondingly mitigated even when the marginal edges of their front and rear side portions 2*c*, 2*d*, 3*c*, 3*d* come into contact with the wearer.

Figure 3:
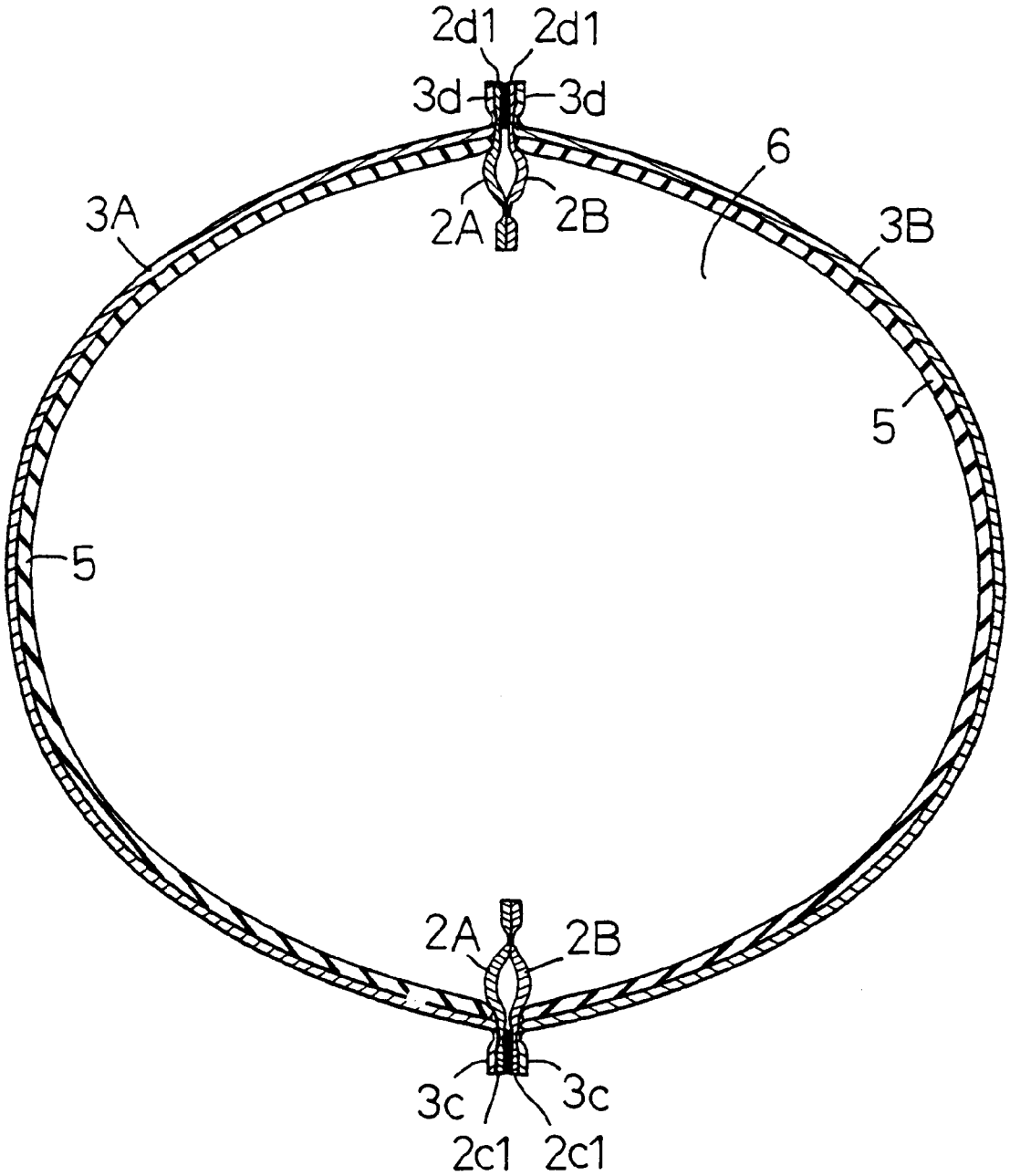
FIG. 3 is a sectional view taken along a line A—A in FIG. 1.

FIG. 3 is a sectional view taken along a line A—A in FIG. 1. Of the inner sheets 2A, 2B bonded to each other, the cutouts 4 are placed upon each other with their edges extending inwardly of the pants 1. The inner sheets 2A, 2B and the outer sheets 3A, 3B are placed one upon another with their front and rear side portions 2*c*, 2*d*, 3*c*, 3*d* extending outward laterally of the pants 1. The pants 1 according to this invention avoids a manner of bonding such that the inner sheets 2A, 2B would be folded outward laterally of the pants 1 in the vicinity of their cutouts 4 to bond the respective sheet surfaces 2*f* of these inner sheets 2A, 2B to each other or the inner sheets 2A, 2B and the outer sheets 3A, 3B would be folded inward laterally of the pants 1 in the vicinity of their front and rear side portions 2*c*, 2*d*, 3*c*, 3*d* to bond the respective sheet surfaces 2*f*, 3*e* to each other, respectively. As an advantageous result, it is not apprehended that these sheets 2A, 2B, 3A, 3B might become bulky along their cutouts 4 as well as along the front and rear side portions 2*c*, 2*d*, 3*c*, 3*d*. The absence of the elastic member 5 along the respective upper ends 2*a* of the inner sheets 2A, 2B makes the pants 1 correspondingly thin and thereby facilitates the pants 1 to be folded in a relatively flat state.

The respective upper ends 2*a* of the inner sheets 2A, 2B each lying between the cutout 4 and the front and rear side portions 2*c*, 2*d* are free from bonding effect and the number of bonded regions is correspondingly reduced. Consequently, even when the regions of the inner sheets 2A, 2B extending in the vicinity of the upper ends 2*a* are tightly pressed against the wearer's skin under a contractile force of the elastic member 5, the wearer does not suffer from a feeling of stiffness.

It is possible without departing from the scope of this invention to configure the inner sheets 2A, 2B and the outer sheets 3A, 3B so that not only the inner edges of the front side portions 2*c*, 3*c* but also the inner edges of the rear side portions 2*d*, 3*d* extend from the upper ends 2*a*, 3*a* toward the lower ends 2*b*, 3*b* so as to describe substantially circular arcs gradually approaching the respective center lines Y1, Y2 or the inner edges define straight lines gradually approaching the center lines Y1, Y2.

Each of the cutouts 4 has its bottom 4*a* put aside from the center line Y1 toward the rear side portion 2*d*. The bottom 4*a* preferably lies between the center line Y1 and the rear side portion 2*d* at a distance from the center line Y1 approximately corresponding to ⅓ of the dimension defined between the center line Y1 and the rear side portion 2*d*. By putting the bottom 4*a* aside from the center line Y1 toward the rear side portion 2*d*, the cutout 4*a* of the pants 1 can be conformed to the curves defined by hip and belly of the wearer as closely as possible.

Nonwoven fabric made of thermoplastic fiber may be used as stock material for the inner sheets 2A, 2B and/or the outer sheets 3A, 3B. It is also possible to use nonwoven fabric perforated to improve its moisture-permeability or the nonwoven fabric having its sheet surface embossed to improve its cushioning property. The inner sheets destined to come in contact with the wearer's crotch are preferably formed by the stock material having a high liquid-absorption, a high moisture-permeability and a high flexibility, for example, nonwoven fabric containing rayon fiber, cotton fiber or the like.

It is also possible to use composite nonwoven fabric (SMS nonwoven fabric) consisting of melt blown nonwoven fabric having a high water resistance and two sheets of spun bond nonwoven fabric having a high strength as well as a high flexibility and respectively covering the opposite sheet surfaces of the melt blown nonwoven fabric. Such SMS nonwoven fabric is obtained by sandwiching melt blown nonwoven fabric with spun bond nonwoven fabric and then bonding the melt blown nonwoven fabric and spun bond nonwoven fabric together using press technique. Use of the SMS nonwoven fabric enables it to make the pants 1 presenting high strength, high water resistance and a comfortable touch.

It is also possible to use nonwoven fabric having a stretchability transversely and/or longitudinally of the sheets 2A, 2B and/or the outer sheets 3A, 3B as stock material for these sheets 2A, 2B, 3A, 3B. In this case, the elastic member 5 which should otherwise be provided along the upper ends 3*a* of the outer sheets 3A, 3B can be eliminated.

The elastic member 5 may be attached either to the outer sheet surfaces 3*f* of the outer sheets 3A, 3B or to both the inner and outer sheet surfaces 3*e*, 3*f* thereof. The elastic member 5 may be formed, for example, from synthetic rubber, natural rubber, stretchable film containing synthetic rubber, or spun bond or melt blown nonwoven fabric containing synthetic rubber as a principal ingredient. It is also possible to use a composite member consisting of nonwoven fabric and an elastic member secured under tension to the nonwoven fabric or a composite member consisting of nonwoven fabric, an elastic member secured under tension to the nonwoven fabric so that the elastic member may be covered with the nonwoven fabric.

Though not shown, it is also possible to dispose a separately provided absorbent sanitary article between a liquid-pervious topsheet and the liquid-impervious backsheet. Such absorbent sanitary article is provided on its bottom surface with a fastening sheet such as urethane foam or pressure-sensitive adhesive sheet having a high friction coefficient adapted to be fastened to holder means extending longitudinally on the inner surface of the pants 1.

Bonding of the sheets 2A, 2B, 3A, 3B and the elastic member 5 may be carried out using suitable adhesive such as hot melt adhesive or thermally sealing technique such as heat- or sonic-sealing technique.

The disposable pants of trunks-type according to this invention is of a simplified construction such that the inner sheets placed upon each other with their sheet surfaces bonded together, on one hand, and the inner sheets and the outer sheets are placed one upon another with their sheet surfaces bonded together. This simplified construction enables the pants suitable as the disposable sanitary article to be made more easily than when cloth or woven fabric is stitched to form the pants. In addition, the inner sheets and/or the outer sheets may be formed by nonwoven fabric to make the pants particularly suitable as the disposable sanitary article at a cost lower than a cost which will be necessary when cloth or woven fabric is used as stock material.

What is claimed is:

1. Disposable trunks-type pants comprising;

a waist-hole;

a pair of leg-holes;

an elastically stretchable member secured under tension to a peripheral portion of the waist-hole so as to extend circumferentially thereof;

a pair of symmetric inner sheets each having upper and lower ends extending in a transverse direction, front and rear side portions extending in a longitudinal direction orthogonal to said transverse direction and a cutout extending from said upper end toward said lower end so as to describe a substantially circular arc which is convex toward said lower end; and a pair of symmetric outer sheets having upper and lower ends extending in said transverse direction and front and rear side portions extending in said longitudinal direction and lying outside said inner sheets, said inner sheets being placed upon each other with said upper and lower ends as well as said front and rear side portions thereof aligned with each other, and facing surfaces thereof bonded to each other at least along zones of said front and rear side portions extending in a vicinity of said upper ends of said inner sheets and said cutouts with said upper and lower ends as well as said front and rear portions of the inner sheets aligned with each other, said inner sheets and said outer sheets being placed upon one another with said upper and lower ends as well as said front and rear side portions thereof aligned with each other, outward facing surfaces of said inner sheets and inward facing surfaces outer sheets being bonded together along said front and rear side portions thereof, and said elastic members being attached to said outer sheets along said upper ends thereof.

2. The disposable trunks-type pants according to claim 1, wherein at least one of said inner sheets and said outer sheets are formed from a nonwoven fabric.

3. The disposable trunks-type pants according to claim 2, wherein said nonwoven fabric comprises a composite nonwoven fabric comprising a melt blown nonwoven fabric and two layers of a spun bond nonwoven fabric.

* * * * *